United States Patent [19]

Sinor

[11] 4,180,452

[45] Dec. 25, 1979

[54] METHOD FOR HYDROGENATION OF COAL

[75] Inventor: Jerry E. Sinor, Longmont, Colo.

[73] Assignee: Cameron Engineers, Inc., Denver, Colo.

[21] Appl. No.: 826,731

[22] Filed: Aug. 22, 1977

[51] Int. Cl.[2] ..... C10G 1/04; C10G 1/08

[52] U.S. Cl. ..... 208/8 LE; 208/10

[58] Field of Search ..... 208/8, 10

[56] References Cited

U.S. PATENT DOCUMENTS

| | | | |
|---|---|---|---|
| 2,133,280 | 10/1938 | Burk | 208/8 |
| 2,223,184 | 11/1940 | Pier et al. | 208/8 |
| 2,556,496 | 6/1951 | Hickey | 208/8 |
| 3,503,865 | 3/1970 | Stone | 208/8 |
| 4,030,893 | 6/1977 | Keller | 208/8 |

*Primary Examiner*—Delbert E. Gantz
*Assistant Examiner*—Joan Thierstein
*Attorney, Agent, or Firm*—Ralph F. Crandell

[57] ABSTRACT

A method for hydrogenating coal to produce benzene and other gas and liquid products. In the process, the coal is pulverized and dried, and then saturated with methanol. The methanol saturated coal is slurryed in benzene and the slurry is exposed to microwave energy of a frequency and for a period of time sufficient to effect hydrogenation of the coal. The benzene liquid effects an immediate quench and the hydrogenation products are collected and separated. The principal product of the hydrogenation is benzene. Unreacted coal and char may be recycled or subjected to gasification with steam and oxygen to produce synthesis gas which can be converted to methanol.

8 Claims, 1 Drawing Figure

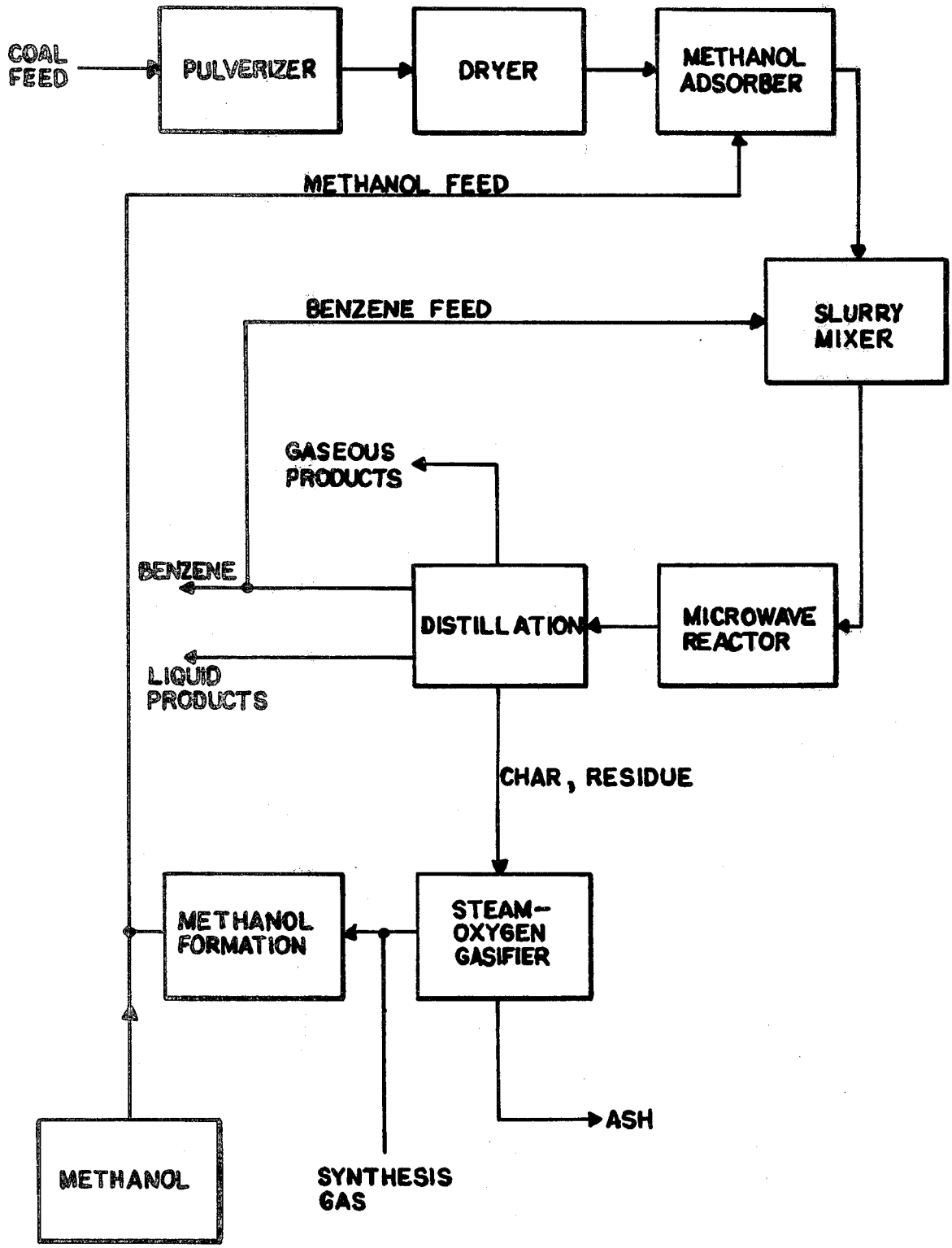
COAL FEED
PULVERIZER
DRYER
METHANOL ADSORBER
METHANOL FEED
BENZENE FEED
SLURRY MIXER
GASEOUS PRODUCTS
BENZENE
DISTILLATION
MICROWAVE REACTOR
LIQUID PRODUCTS
CHAR, RESIDUE
METHANOL FORMATION
STEAM-OXYGEN GASIFIER
ASH
METHANOL
SYNTHESIS GAS

METHOD FOR HYDROGENATION OF COAL

FIELD OF THE INVENTION

The present invention relates to the hydrogenation of coal, and more particularly to the manufacture of benzene and other gaseous and liquid materials, suitable for use as fuels or chemical feed stocks, from coals such as lignite and bituminous coals.

PRIOR ART

It is generally well-known in the art that coal may be converted to various liquid and gaseous products by reaction with hydrogen. In raw coal, the weight ratio of carbon to hydrogen is typically in the range of 15 or 20 to 1, whereas the ratio must be no higher than about 8 to 1 for a synthetic crude oil which can be fed to a typical petroleum refinery. The addition of hydrogen, or hydrogenation, may be accomplished by the direct contact of coal with gaseous hydrogen; by a catalyzed liquid-phase reaction with hydrogen; by a liquid-phase reaction with a hydrogen-donor liquid; or by reacting coal with steam. Many different processes have been proposed and are under development. These schemes, or hydrogenation processes, vary in the method of contacting coal with the hydrogen source and in the reaction conditions used, including temperature, pressure, reaction time and catalyst.

The principal problem is to react coal in such a way as to maximize the yield of fluid products. A number of researchers have shown that, if the entire coal particle is heated rapidly, at the beginning of the coal pyrolysis a transient period exists for only a fraction of a second wherein the coal is highly reactive toward hydrogen. If hydrogen is not available during this short period, some of the free-radical pyrolytic fragments of the coal molecules will strip molecular hydrogen from the aromatic groups, contained in the coal while other fragments will polymerize to form unreactive char. The overall effect is a limited early yield of light liquid and gaseous products and a large yield of heavy tars and char. Further, hydrogenation of these heavy materials then proceeds slowly. If instead, excess hydrogen is present during the critical transient period, the pyrolytic fragments which are formed first will be stabilized by reaction with the hydrogen and a much larger yield of light gases and liquids will result.

It has been demonstrated that hydrogen need not be supplied in elemental form to accomplish coal hydrogenation. Numerous processes under development utilize a hydrogen-donor liquid which contains bound hydrogen in a more or less mobile form. Various petroleum or coal-derived liquids make satisfactory donors, among which methanol has been shown to be effective. Water can also be used as a hydrogen source, although the carbon-steam reaction does not proceed readily at low temperatures and pressures.

Typical reaction conditions in prior art processes for coal hydrogenation involve temperatures on the order of about 600° C. or more and hydrogen pressures of 100 atmospheres or more. When coal is heated slowly, it passes through a plastic stage in which the molecules rearrange themselves into larger and less reactive fragments. The transient period of high reactivity alluded to previously does not occur. Once the reaction temperature is reached, hydrogenation begins at a slow rate, with the formation of relatively high molecular weight liquids. All large-scale hydrogenation processes developed to date operate in this slow-reaction mode at high temperatures and pressures and are therefore largely uneconomical to pursue.

Some research has been accomplished using rapid heating rates to take advantage of the transient period of high reactivity. This transient period only results if the entire particle is heated to pyrolytic temperatures before the condensation and polymerization reactions which form tars and char have progressed significantly.

In U.S. Pat. No. 3,030,297, to W. C. Schroeder, there is described a process which comprises heating dry particles of coal entrained in a stream of hydrogen at a total pressure of about 500–6000 psig, from a temperature below about 300° C. to a reaction temperature in the range of from about 600° C. to about 1000° C. About two minutes are required to heat the coal particles to about 600° C., and then about two to twenty seconds are required at temperature for hydrogenation. The slow heat-up results from the main hydrogen stream being utilized to carry the coal into the reactor. The products of reaction are then cooled to below the reaction temperature to provide a product comprised of light oil which is predominantly aromatic in nature, and hydrocarbon gases, primarily methane, ethane, and carbon monoxide. The Schroeder process has the disadvantage in that the coal particles entrained in the hydrogen are preheated prior to introduction into a heating chamber so that the reaction process is started upstream of the reaction chamber, often causing agglomeration and plugging within the conduit carrying the entrained coal. The Schroeder process has the further disadvantage in that it involves heating the entrained coal particles through a tube wall. It is extremely difficult to transfer enough heat through the tube wall within a reasonable length to sufficiently heat the coal and, at the same time, use the tube wall to contain the system pressure. Furthermore, this type of reactor cannot be readily scaled up to larger diameters for commercial coal conversion because the heat transfer surface-to-volume ratio decreases rapidly with an increase in size.

Rapid quenching is an essential key to obtaining a large yield of liquid products rather than gaseous products. At a residence time of more than a fraction of a second in the rapid reaction stage, hydrogenation will proceed rapidly to the formation of gases with a large hydrogen consumption. Economic considerations dictate that hydrogen consumption should be minimized. Experiments have been reported in the literature where cyrogenically cooled hydrogen has been used to quench the reaction products and obtain a high yield of benzene as the major liquid product. It is doubtful that a commercial process could result from such a scheme because of the high cost of cold hydrogen or other cyrogenic cooling gas.

A process for gasifying carbonaceous matter is disclosed by J. W. Hand in U.S. Pat. No. 3,963,426 "Process for Gasifying Carbonaceous Matter."

OBJECT OF THE INVENTION

The principal object of the present invention is to provide an improved process for the hydrogenation of coal.

More specifically, it is an object of the present invention to provide an improved hydrogenation process which produces a maximum yield of liquid products with a minimum of hydrogen consumption.

A further object of the present invention is to provide a process of the foregoing character which can be carried out ambient temperatures and pressures, and particularly at room temperature and atmospheric pressure.

Still a further object of the present invention is to provide an improved hydrogenation process of the foregoing character in which substantially all of the coal composition is utilized with a minimum production of char, coke, and other nonconvertible materials.

A further object of the present invention is to reduce the amount of energy required to effect the hydrogenation reaction.

Still a further object of the present invention is to minimize the secondary decomposition of liquids to gases and the secondary polymerization of liquids to tars and char.

Still another object of the present invention is to prevent the agglomeration of coal particles in the reaction apparatus and thereby preclude heating of the coal particles by thermal conduction.

Other objects and advantages of the present invention will become apparent from the following detailed description and accompanying drawing.

SUMMARY OF THE INVENTION

The foregoing objects are accomplished by the process of the present invention wherein a coal material, such as bituminous coal or lignite, is ground or pulverized to a particle size of about −100 mesh, that is about 0.15 millimeters. The pulverized coal is dried to a moisture content of less than about 1%. The dried pulverized coal is then saturated with methanol or other suitable hydrogen donor liquid capable of fully penetrating the internal pores of the pulverized coal material and having a large absorption efficiency for microwave energy. The methanol saturated coal is then slurryed with benzene or other liquid which was a low absorptivity for microwaves, a high heat capacity and a high thermal stability in the presence of coal pyrolysis products. Benzene is microwave transparent and is desirable because it is one of the principal products of the pyrolysis reaction.

The benzene-coal slurry is then subjected to microwave energy of a frequency and for a period of time sufficient to carry out the hydrogenation reaction. The microwave energy rapidly heats the donor liquid within the coal pores to the reaction temperature without heating the surrounding liquid. The hydrogenation reaction is accomplished substantially instantenously, and the surrounding slurry liquid, such as benzene, acts as a heat sink to quench the reactive fragments formed from the coal-methanol reaction.

The reaction mixture from the microwave reactor is then distilled to produce gaseous products, liquid products, benzene and char and other residues. A portion of the benzene is utilized as the benzene feed to the slurry mixer and the remaining benzene is recovered as a useful product. Similarly, the gaseous and liquid products are recovered for subsequent use. The char and residue are fed to a steam-oxygen gasifier which produces synthesis gas from which methanol can be formed. The methanol is utilized as the methanol feed to the methanol absorber. The principal products of the process are benzene together with other gaseous and liquid products typical of hydrogenation reactions.

DESCRIPTION OF THE DRAWING

The FIGURE of the drawing is a schematic flow diagram illustrating the process of the present invention.

DESCRIPTION OF THE PREFERRED EMBODIMENT

In accordance with the present invention, a coal or coal type material, such as bituminous coal or lignite, is ground or pulverized to a finely divided form and dried without pyrolysis. These materials will be referred to generally herein as "coal." The coal is ground or pulverized in a conventional mill or grinder to a particle size of about −100 mesh, that is to a particle size of about 0.15 millimeters or smaller. A fine particle size is desirable in order to enhance the subsequent hydrogenation reaction.

Following grinding, the coal material is desirably dried to a moisture content of less than about 1% moisture. For this purpose conventional drying equipment may be utilized.

In order to provide a hydrogen source, intimately admixed with the coal, the dried coal particles are completely saturated with a hydrogen-donor liquid which is capable of acting as a source of hydrogen or a coal hydrogenation agent. The hydrogen must be a liquid of a small enough molecular size to penetrate the coal pores, and must be a strong absorber of microwave energy. One such hydrogen donor liquid is the aliphatic alcohol methanol. This material is known to be capable of hydrogenating coal at high temperatures, and penetrates coal pores extremely well. Pycnometer densities obtained with methanol are reported to be higher than those obtained with helium, indicating the formation of a tight surface complex within the pores of the coal or coal material.

The methanol impregnated coal particles are then suspended as a slurry in a nonpolar, microwave-transparent or non-microwave absorbing medium. One illustrative material finding particular utility in this regard is the liquid aromatic organic solvent benzene. This aromatic material is particularly useful because the principal product of the hydrogenation of coal is benzene. By utilizing benzene, which is a nonpolar microwave-transparent medium, a further separation to recover the slurry medium is avoided. The coal-benzene slurry is formed in a weight ratio of about 1 to 1 to provide a sufficiently flowable medium for subsequent processing in the hydrogenation reaction.

From the slurry mixer, the coal-benzene slurry is fed at room temperature and atmospheric pressure to a microwave reactor. In the reactor, the slurry is subjected to microwave energy at a frequency and for a time sufficient to heat the hydrogen donor liquid, methanol, rapidly to reaction temperature. During the heating of the donor liquid within the pores of the coal, the surrounding slurry liquid, benzene, being a nonpolar microwave transparent medium, is not heated by the microwave energy and remains relatively cool. The benzene has a low absorptivity for the microwaves, a high heat capacity and a high thermal stability in the presence of coal-pyrolysis products. The benzene further has the ability to be recycled or recovered from the reaction mixture.

Upon subjecting the methanol saturated coal particles to microwave energy, the donor liquid is rapidly heated within the interstices of the coal particles to reaction temperature. Upon reaching the reaction temperature, in the space of a fraction of a second, the methanol immediately reacts with the carbon materials in the coal to produce hydrogenation products, principally benzene, as well as light oils, gasoline and various gaseous products.

The benzene slurry liquid, being transparent to microwave energy, remains relatively cool and acts as a heat sink to immediately quench the reactive fragments formed from the coal-methanol reaction. The hydrogenation reaction thus takes place substantially instaneously followed by instantaneous cooling. The reaction and subsequent cooling occur in a fraction of a second thereby preventing heat build up in the coal and resulting in a high benzene yield.

The microwave frequencies for industrial use are established by the Federal Communications Commission as shown in Table I.

TABLE I

| Frequency (MHz) | Band (Letter) | Wavelength (meters) |
|---|---|---|
| 890–940 | L | 0.330 |
| 2,400–2,500 | S | 0.122 |
| 5,725–5,875 | C | 0.052 |
| 22,000–22,250 | K | 0.008 |

Microwave processing systems and equipment are known in the art. In these systems, electric line current is converted to D.C. by a direct current power supply. This D.C. energy is applied to a high power microwave tube which converts the direct current into microwave energy. The microwave energy is in turn transmitted to the applicator or reaction through a wave guide, conventionally a simple rectangular pipe. In the microwave reaction equipment or reactor, the microwave energy is converted into heat in the process material by the action of dipole rotation. See for example, the discussion of the use of microwave apparatus for carbonizing carbonaceous materials described in U.S. Pat. No. 3,560,347, issued to E. M. Knapp et al. for "Apparatus for Carbonizing Carbonaceous Materials Using Microwave Energy."

From the microwave reactor, the slurry including the slurry liquid, reaction products, and coal residues, are fed to appropriate distillation equipment from which gaseous products, liquid products, benzene and char and other residues are produced. A portion of the benzene is recycled as the benzene feed to the slurry mixer, while the remaining benzene is separated, collected, and utilized in other processes or sold. Similarly, the liquid and gaseous products are appropriately collected and subsequently utilized.

From the distillation process, the char and carbonaceous residue is fed to a steam and oxygen carbonaceous material gasifying process such as the process described in U.S. Pat. No. 3,963,426. Synthesis gas from the gasifier is utilized to produce methanol in a conventional methanol process, and the ash is discarded. The methanol produced from the methanol process, together with additional make up methanol if required, is fed to the methanol absorber.

The process of the present invention is an efficient and economical integrated process capable of producing heretofore unavailable high yields of benzene as well as other light liquid and gaseous products. The process is further capable of producing all or a substantial portion of the methanol reactant required thus enhancing the economy of the process.

While an illustrative process embodying the present invention has been described in considerable detail, it should be understood that there is no intention to limit the invention to the specific form disclosed. On the contrary, it is the intention to cover all modifications, equivalents, alternatives and uses of the present invention falling within the spirit and scope of the invention as expressed in the appended claims.

I claim as my invention:

1. A method for hydrogenating coal comprising the steps of:

pulverizing and drying the coal;

saturating the dried, pulverized coal with methanol;

slurrying the methanol saturated coal in benzene to form a coal-benzene slurry;

exposing the coal-benzene slurry to microwave energy for a period of time sufficient to effect hydrogenation of the coal; and collecting and separating the hydrogenation products.

2. The method defined in claim 1 wherein said coal-benzene slurry is maintained at a pressure of at least one atmosphere during the microwave exposure step.

3. The method as defined in claim 1 wherein said coal-benzene slurry is maintained at about room temperature during the microwave exposure step.

4. The method as defined in claim 1 wherein the coal is pulverized to a particle size of about −100 mesh.

5. The method as defined in claim 1 wherein said coal benzene slurry is subjected to microwave heating for a period of time of less than about 1 second but sufficient to accomplish the desired hydrogenation reaction.

6. The method as defined in claim 1 wherein said coal-benzene slurry is formed of about equal parts by weight of benzene and coal.

7. A method for hydrogenating coal comprising the steps of:

pulverizing the coal to a particle size of about −100 mesh;

drying the pulverized coal to a moisture content of less than about 1 percent;

saturating the dried, pulverized coal with methanol;

slurrying the methanol saturated coal in an equal weight of benzene to form a coal-benzene slurry;

exposing the coal-benzene slurry to microwave energy of a frequency and for a time period sufficient to effect hydrogenation of the coal; and collecting and separating the hydrogenation products thereby produced.

8. A method for hydrogenating coal comprising the steps of saturating finely ground coal with methanol, slurrying the methanol saturated coal in benzene to form a coal-benzene slurry, exposing the coal-benzene slurry to microwave energy of a frequency and for a period of time sufficient to effect hydrogenation of the coal; and collecting and separating the hydrogenation products.

* * * * *